US006157176A

United States Patent [19]

Pulvirenti et al.

[11] Patent Number: 6,157,176

[45] Date of Patent: Dec. 5, 2000

[54] LOW POWER CONSUMPTION LINEAR VOLTAGE REGULATOR HAVING A FAST RESPONSE WITH RESPECT TO THE LOAD TRANSIENTS

[75] Inventors: Francesco Pulvirenti, Acireale; Patrizia Milazzo, Messina, both of Italy

[73] Assignee: STMicroelectronics S.r.l., Agrate Brianza, Italy

[21] Appl. No.: 09/114,564

[22] Filed: Jul. 13, 1998

[30] Foreign Application Priority Data

Jul. 14, 1997 [EP] European Pat. Off. ..... 97830348

[51] Int. Cl.[7] ..... G05F 1/40; G05F 1/573

[52] U.S. Cl. ..... 323/266; 323/277; 323/282

[58] Field of Search ..... 323/266, 277, 323/267, 268, 282, 284

[56] References Cited

U.S. PATENT DOCUMENTS

| | | | |
|---|---|---|---|
| 4,906,913 | 3/1990 | Stanojevic | 323/303 |
| 5,548,205 | 8/1996 | Monticelli | 323/274 |
| 5,578,916 | 11/1996 | Muterspaug | 323/267 |
| 5,592,072 | 1/1997 | Brown | 323/268 |
| 5,774,021 | 6/1998 | Szepesi et al. | 330/257 |
| 5,864,225 | 6/1999 | Bryson | 323/268 |

FOREIGN PATENT DOCUMENTS

| | | | |
|---|---|---|---|
| 0 476 365 A1 | 3/1992 | European Pat. Off. | H03K 17/04 |
| 0 742 509 A3 | 11/1996 | European Pat. Off. | G05F 1/575 |

*Primary Examiner*—Shawn Riley
*Assistant Examiner*—Rajnikant B. Patel
*Attorney, Agent, or Firm*—Theodore E. Galanthay; Allen, Dyer, Doppelt, Milbrath & Gilchrist, P.A.

[57] ABSTRACT

A linear type of voltage regulator, having at least one input terminal adapted to receive a supply voltage and one output terminal adapted to deliver a regulated output voltage, includes a power transistor and a driver circuit for the transistor. The driver circuit includes an operational amplifier having an input differential stage biased by a bias current which varies proportionally with the variations of the regulated output voltage at the output terminal of the regulator.

20 Claims, 3 Drawing Sheets

LOW POWER CONSUMPTION LINEAR VOLTAGE REGULATOR HAVING A FAST RESPONSE WITH RESPECT TO THE LOAD TRANSIENTS

FIELD OF THE INVENTION

This invention relates to voltage regulators, and, more particularly to a linear type of voltage regulator useful with battery-powered portable devices.

BACKGROUND OF THE INVENTION

A typical linear type voltage regulator for a battery-powered portable device should exhibit very fast response to load transients, low voltage drop, high rejection to the supply line, and above all, low current consumption so that the battery charge can be made to last longer. Current regulators are typically implemented using an n-channel MOS power transistor. The reason for preferring an n-channel transistor is that, for a given performance level, it allows the occupation of silicon area to be optimized and the value of the output capacitor to be reduced by at least one order of magnitude.

An exemplary application of a conventional type of voltage regulator is illustrated in FIG. 1. A regulator of the low-drop type having an n-channel topology, such as that shown in FIG. 1, requires a driver circuit OP1 being supplied a higher voltage, VCP, than the supply voltage, VBAT. This is a feature which has been achieved in state-of-art regulators by using a charge pump circuit 2.

The operation of the device in the circuit of FIG. 1 and its application will now be described in detail. The current consumption of the regulator can be calculated from the current Ires flowing through the divider R1–R2, plus the current draw Iop of the driver circuit OP1 for the power transistor M1.

Since the charge pump circuit 2 used for powering the driver circuit OP1 is a multiplier-by-n of the input voltage VBAT, its current draw from the battery is n times the current Iop that it delivers to the driver circuit OP1. Considering, moreover, the efficiency Eff of the charge pump circuit, the overall battery current consumption of the regulator is:

$$IREG=n/Eff*Iop+Ires.$$

The compensation usually employed for a regulator with this topology is of the pole-zero type, where the internal zero is to cancel out the pole introduced by the load capacitor. The outcome of such compensation is that a dominant pole is obtained, which considerably slows the response to load transients and produces a large output voltage variation.

A prior approach to this problem included increasing the bias current Iop of the differential stage of the driver circuit OP1, with the consequence of increasing the overall consumption of the regulator. This approach conflicts, however, with the main desirable characteristic of battery-powered devices, that is, to keep current consumption as low as possible.

SUMMARY OF THE INVENTION

In view of the foregoing background, it is therefore an object of the present invention to provide a voltage regulator of the linear type controlled for optimum current consumption, which can exhibit fast response to the load transients and minimize the average consumption of the regulator.

This and other objects of the present invention are provided by a linear type of voltage regulator wherein the bias current of the differential input stage is varied proportionally with variations of the regulated output voltage at the output of the regulator. In particular, the regulator has at least one input for receiving a supply voltage and one output for delivering a regulated output voltage. The voltage regulator includes a power transistor having a control terminal and a main conduction path connected between the input and the output of the regulator. The regulator also includes an operational amplifier comprising an input differential stage biased by the bias current, and having a first input connected to a voltage reference, a second input coupled to the output of the regulator, and an output connected to the control terminal of the power transistor.

The present invention is based upon using a driver circuit OP1 for the power transistor M1, which has an input differential stage biased by a bias current that varies proportionally with the variations in the output voltage VOUT.

BRIEF DESCRIPTION OF THE DRAWINGS

The features and advantages of the circuit according to this invention will be more clearly apparent from the following detailed description of embodiments thereof, shown by way of non-limitative example in the accompanying drawings.

DETAILED DESCRIPTION OF THE PREFERRED EMBODIMENTS

Figure 2:
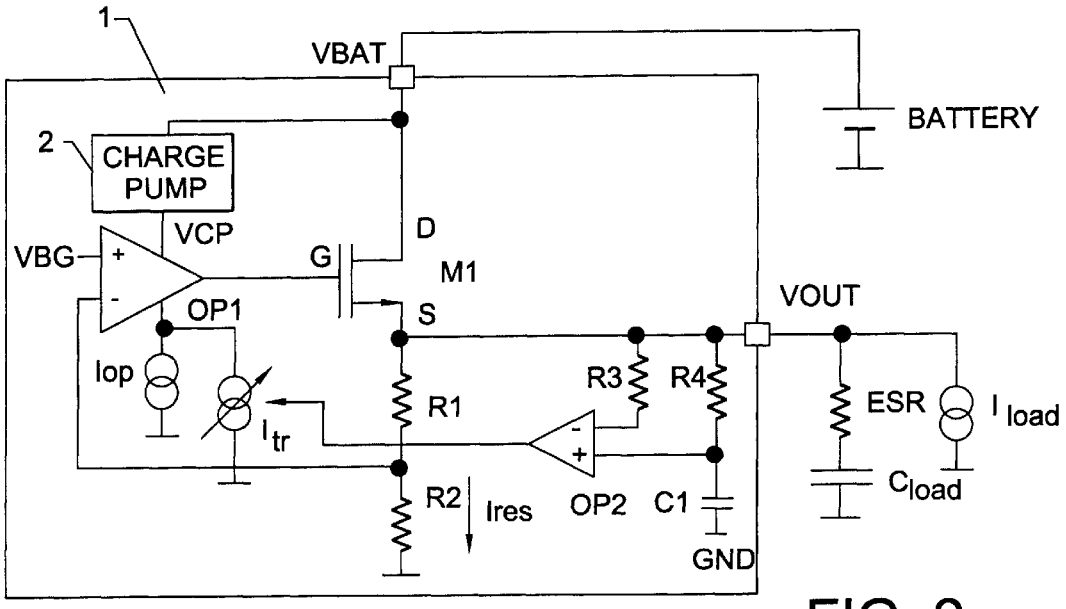
FIG. 2 shows a linear type of voltage regulating circuit according to this invention.

Shown in FIG. 2 is a voltage regulating circuit 1 of the linear type which embodies this invention. The regulating circuit 1 is connected between a battery (BATTERY), itself connected to a terminal VBAT of the circuit, and a load. The load is connected to a terminal VOUT and illustrated schematically by a generator of an equivalent current Iload in parallel with a load capacitor Cload having an equivalent series resistor ESR.

The following circuit components make up the regulating circuit 1:

a power transistor M1 of the n-channel MOS type having a main drain-source conduction path connected between the terminals VBAT and VOUT of the circuit 1;

an operational amplifier OP1, which is used as a driver circuit for the power transistor M1, has an input differential stage biased by a certain bias current Iop, a non-inverting input terminal connected to a voltage reference VBG, an inverting input terminal coupled to the output terminal VOUT of the circuit 1 through a resistive divider R1–R2, and an output terminal connected to the control terminal G of the power transistor M1;

a charge pump circuit 2 used for powering the operational amplifier OP1; and a transconductance operational amplifier OP2, Itr having an inverting (–) input terminal coupled to the output terminal VOUT of the regulator through a resistor R3, and a non-inverting (+) input terminal coupled to the output terminal VOUT of the regulator through a low-pass filter C1, R4.

The low-pass filter comprises a resistor R4 connected between the regulator output terminal VOUT and the non-inverting (+) input of the transconductance operational amplifier OP2, and a capacitor C1 connected between the non-inverting (+) input of the amplifier OP2 and a fixed voltage reference GND.

The operation of the circuit shown in FIG. 2 will now be described. As the load current Iload goes from a minimum value to a maximum value, for example, the output voltage VOUT begins to drop due to the slow driving of the transistor M1 by the operational amplifier OP1. This variation in the output voltage VOUT reflects immediately on the inverting (−) input of the transconductance operational amplifier OP2, whereas the voltage at the non-inverting input is filtered by the low-pass filter network R4–C1.

Under this condition, the output of the transconductance operational amplifier OP2, including a driven current generator, designated Itr in the Figure, affects the bias current of the input differential stage of the operational amplifier OP1, increasing its value. In fact, the current Itr adds to the bias current Iop of the operational amplifier OP1 in the rest condition.

Thus, the overall bias current of the input differential stage of the operational amplifier OP1, driving the power transistor M1, will move higher the larger the variation in the voltage applied to the output terminal VOUT of the regulator. This enhances the speed of response of the circuit.

Accordingly, the current consumption of the regulator will only increase during those load transients which induce variations in the value of the output voltage VOUT. On termination of the transient, the inputs of the operational amplifier OP2 return to the same potential, restoring the current generator Itr to its very low or zero initial value.

Figure 3:
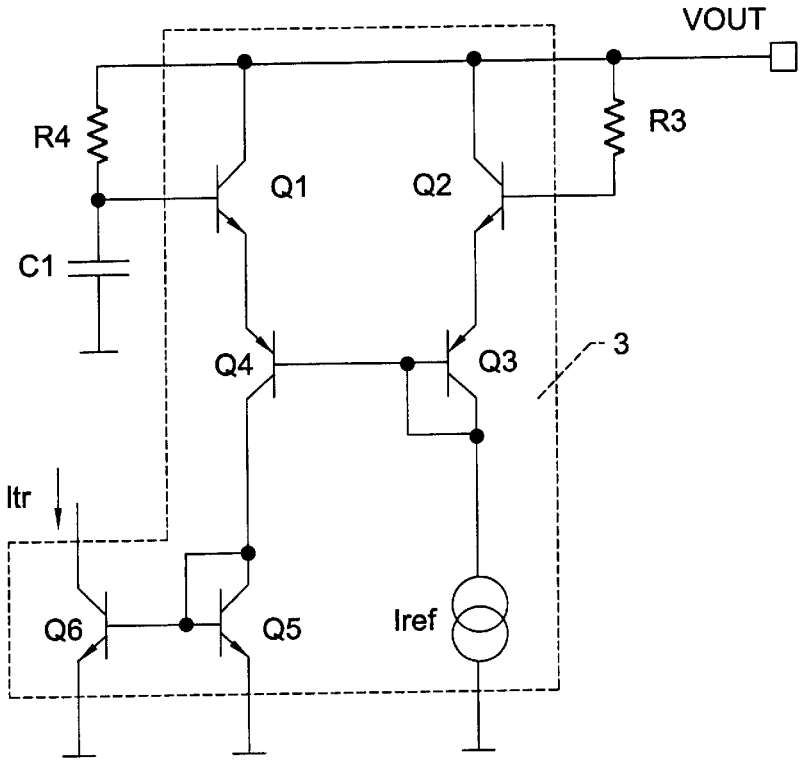
FIG. 3 shows a first embodiment of a portion of the voltage regulating circuit in FIG. 2.

The proposed approach has been implemented using BCD (Bipolar-CMOS-DMOS) technology. FIG. 3 shows diagrammatically a circuit, generally referenced 3, of a first embodiment of the transconductance operational amplifier OP2, and the current source for Itr using bipolar transistors. The circuit 3 comprises an input differential stage including transistors Q1, Q2, Q3, Q4, a generator of a reference current Iref, and an output current mirror Q5, Q6.

Assuming that all the (npn and pnp) transistors are of unity area, in a condition of constant load, the current Itr will be equal to Iref. If the output voltage VOUT tends to drop, due to a load transient, the voltage at the base of Q2 immediately follows the voltage VOUT, while the base voltage of Q1 decreases at a time constant equal to R4*C1. Under this condition, the collector currents of Q1 and Q4 increase, resulting in an increased output current Itr.

Calling ΔV the voltage variation at the output VOUT, the current Itr is given by:

$$Itr=Iref*e^{\Delta V/(1+n)*V_T}$$

where η is the emission coefficient of the transistors Q3 and Q4.

When the voltage transient at the output VOUT terminates, and the voltages at the bases of the transistors Q1 and Q2 revert to the same potential, the collector currents of Q1 and Q2 are returned to a balanced condition. Accordingly, the current Itr decreases to its initial value Iref. Thus, when using the circuit of FIG. 3, the bias current will only increase as the output voltage VOUT tends to drop. The steady state consumption is 3 microamperes for the circuit of FIG. 3, and is obtained from a reference current Iref of 1 microampere.

The consumption of the operational amplifier OP1 amounts to about 4 microamperes. Considering that this amplifier is supplied a boosted voltage VCP from the charge pump circuit 2, and that the circuit 2 is a voltage tripler, the current drawn from the battery will be 4*3=12 microamperes. The current Ires flowing through the divider R1–R2 is 4 microamperes. Therefore, the overall consumption of the regulator will amount approximately to 16 microamperes.

Figure 1:
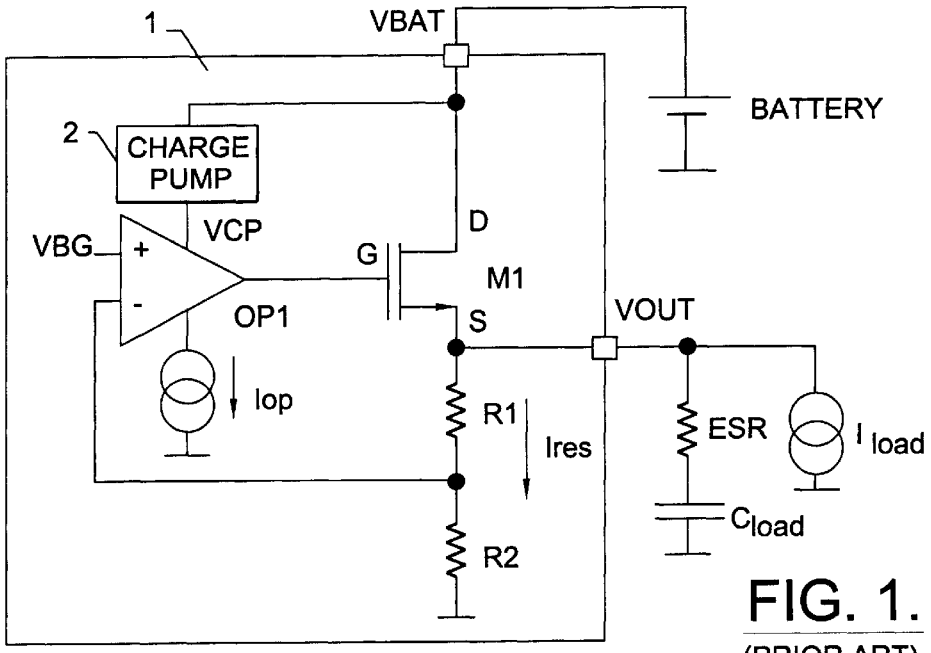
FIG. 1. (PRIOR ART)
FIG. 1 shows a linear type of voltage regulating circuit according to the prior art.

On the other hand, when using a conventional type of circuit, such as that shown in FIG. 1, the overall consumption in the steady state condition would be about 45 microamperes, for a like performance in terms of response to load transients. The circuit in accordance with the present invention can be extended to include applications where a fast response to both connections and disconnections of the load is demanded. This is so even where the load current on the voltage regulator may decrease sharply or, upon disconnection of the load, drop to zero.

Figure 4:
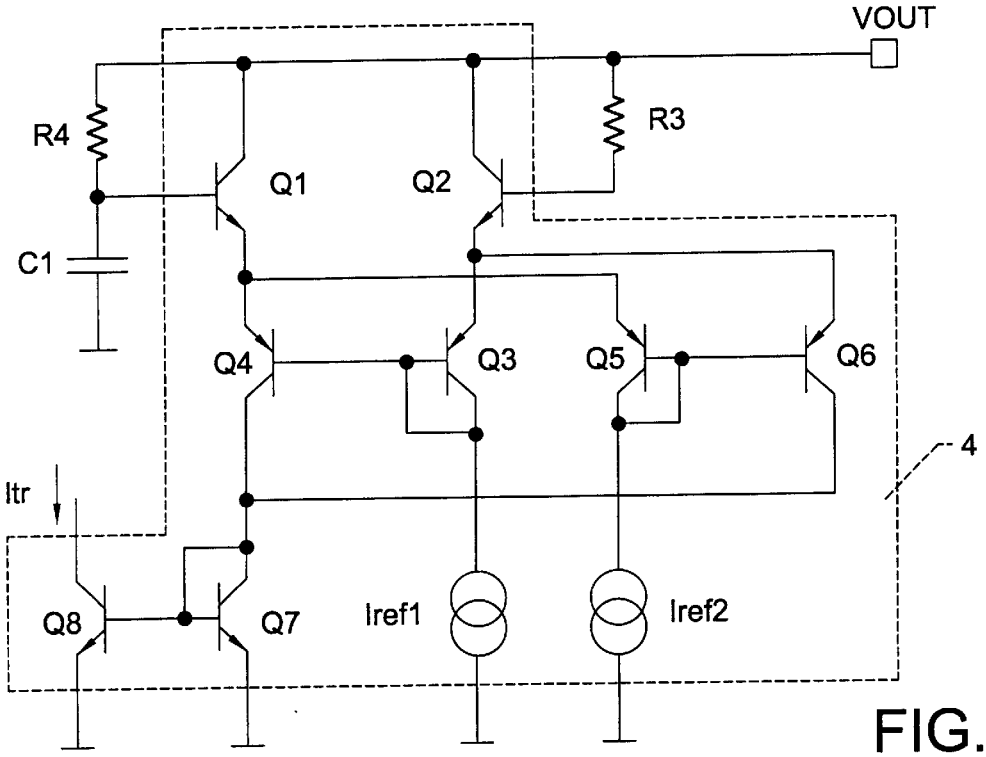
FIG. 4 shows a second embodiment of a portion of the voltage regulating circuit in FIG. 2.

FIG. 4 shows a second embodiment, generally referenced 4, of the transconductance operational amplifier OP2, for generating Itr, which is also implemented by bipolar transistors. The circuit 4 comprises a double input differential stage consisting of transistors Q1, Q2, Q3, Q4, Q5, Q6, two generators of reference currents Iref1 and Iref2, and an output current mirror Q7, Q8. The differential stage is arranged such that the transistor pair Q3 and Q4 amplify the current Iref1 on the occurrence of a negative transient of the voltage VOUT, similar to the circuit of FIG. 3, while the transistor pair Q5 and Q6 amplify the current Iref2 on the occurrence of a positive transient of the voltage VOUT.

Assuming unity area for all (npn and pnp) transistors, in a condition of constant load, the current Itr will be Iref=Iref1+Iref2. If the output voltage VOUT tends to drop, due to a sharp increase in the load current, the base voltage of the transistor Q2 also drops immediately, following the voltage VOUT, while the base voltage of Q1 decreases at a time constant equal to R4*C1. Under this condition, the collector currents of Q1 and Q4 will increase and result in the output current Itr also increasing.

On the other hand, if the output voltage VOUT increases, due to a sharp decrease in the load current, then the base voltage of the transistor Q2 increases immediately, following the voltage VOUT, while the base voltage of Q1 increases at a time constant equal to R4*C1. In this case, the collector currents of Q2 and Q6 will increase and result in the output current Itr also increasing. In this way, the current Itr is increased whenever positive or negative variations occur in the output voltage VOUT of the regulator.

Figure 5A:
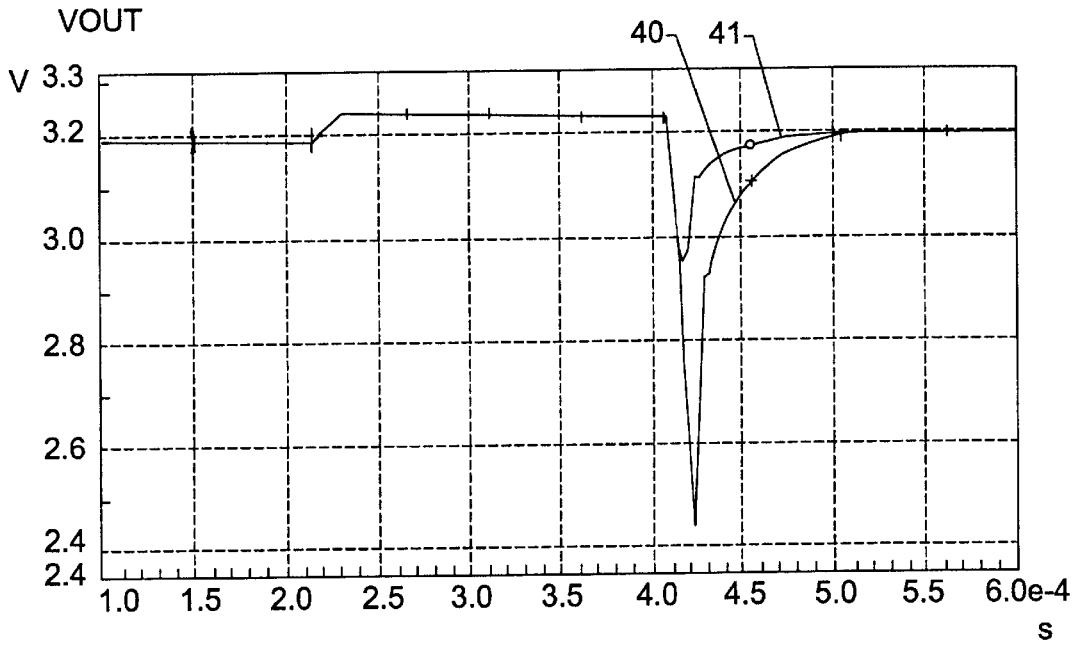
FIG. 5 shows plots versus time of some voltage and current signals, as obtained by electrical simulation of the circuit in FIG. 2.
Figure 5B:
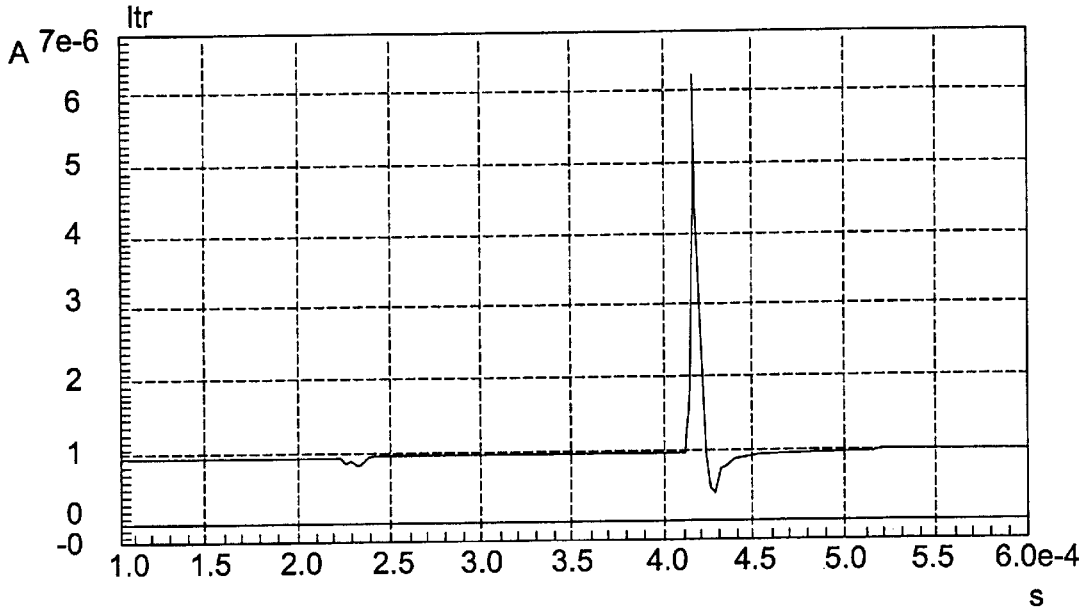

FIG. 5 shows plots of the output voltage VOUT, graph (a), and the current Itr, graph (b), as obtained by electrical simulation of the circuit. The signal VOUT pattern obtained when using this circuit, curve 41, overlaps the pattern of the same signal, curve 40, when this circuit is not used. The different voltage drop across the signal is quite apparent.

It will be appreciated that this operating principle can also be used with regulators having different topologies. The advantages of this approach can be summarized as follows: improved speed of response to transients of the differential stage of a linear regulator; and low average current consumption.

That which is claimed is:

1. A linear voltage regulator having at least one input for receiving a supply voltage and one output for delivering a regulated output voltage, the voltage regulator comprising:

a power transistor having a control terminal and a main conduction path connected between the input and the output of the voltage regulator;

an operational amplifier comprising an input differential stage biased by a bias current, and having a first input connected to a voltage reference, a second input coupled to the output of the voltage regulator, and an output connected to the control terminal of the power transistor; and bias current generating means for generating the bias current for said input differential stage of said operational amplifier so that the bias current varies proportionally with variations of the regulated output voltage at the output terminal of the voltage regulator.

2. A voltage regulator according to claim 1, wherein said bias current generating means comprises:

a first constant current generator for generating a first current;

a transconductance operational amplifier having at least one input coupled to the output of the regulator for generating a second current; and means for summing the first current and the second current to generate the bias current.

3. A voltage regulator according to claim 2, wherein said transconductance operational amplifier comprises a plurality of bipolar transistors.

4. A voltage regulator according to claim 2, wherein said transconductance operational amplifier has an inverting input and a non-inverting input; and further comprising:

a resistor connected between the inverting input of said transconductance operational amplifier and the output of the voltage regulator; and a low-pass filter connected between the non-inverting input of said transconductance operational amplifier and the output of the voltage regulator.

5. A voltage regulator according to claim 4, wherein said low-pass filter comprises:

a resistor connected between the output of the voltage regulator and the non-inverting input of said transconductance operational amplifier; and a capacitor connected between the non-inverting input of said transconductance operational amplifier and a fixed voltage reference.

6. A voltage regulator according to claim 1, wherein said power transistor comprises an n-channel MOS transistor.

7. A voltage regulator according to claim 1, further comprising a charge pump connected to said operational amplifier for supplying thereto a boosted voltage above the supply voltage.

8. A voltage regulator according to claim 1, further comprising a voltage divider connected to the output of the voltage regulator; and wherein the first input of the operational amplifier is a non-inverting input, and the second input is an inverting input coupled to the output of the voltage regulator through said voltage divider.

9. A voltage regulator having at least one input for receiving a supply voltage and one output for delivering a regulated output voltage, the voltage regulator comprising:

a power transistor having a control terminal and a main conduction path connected between the input and the output of the voltage regulator;

an operational amplifier comprising an input differential stage biased by a bias current, and having a first input connected to a voltage reference, a second input coupled to the output of the voltage regulator, and an output connected to the control terminal of the power transistor; and a bias current generator for generating the bias current for said input differential stage of said operational amplifier so that the bias current varies based upon variations of the regulated output voltage at the output of the voltage regulator to increase transient response speed.

10. A voltage regulator according to claim 9, wherein said bias current generator comprises a transconductance operational amplifier having at least one input coupled to the output of the voltage regulator.

11. A voltage regulator according to claim 10, wherein said transconductance operational amplifier generates a second current; and wherein said bias current generator further comprises:

a first constant current generator for generating a first current; and means for summing the first current and the second current to generate the bias current.

12. A voltage regulator according to claim 10, wherein said transconductance operational amplifier comprises a plurality of bipolar transistors.

13. A voltage regulator according to claim 10, wherein said transconductance operational amplifier has an inverting input and a non-inverting input; and further comprising:

a resistor connected between the inverting input of said transconductance operational amplifier and the output of the voltage regulator; and a low-pass filter connected between the non-inverting input of said transconductance operational amplifier and the output of the voltage regulator.

14. A voltage regulator according to claim 13, wherein said low-pass filter comprises:

a resistor connected between the output of the voltage regulator and the non-inverting input of said transconductance operational amplifier; and a capacitor connected between the non-inverting input of said transconductance operational amplifier and a fixed voltage reference.

15. A voltage regulator according to claim 9, wherein said power transistor comprises an n-channel MOS transistor.

16. A voltage regulator according to claim 9, further comprising a charge pump connected to said operational amplifier for supplying thereto a boosted voltage above the supply voltage.

17. A voltage regulator according to claim 9, further comprising a voltage divider connected to the output of the voltage regulator; and wherein the first input of the operational amplifier is a non-inverting input, and the second input is an inverting input coupled to the output of the voltage regulator through said voltage divider.

18. A method for operating a voltage regulator having at least one input for receiving a supply voltage and one output for delivering a regulated output voltage, the voltage regulator of a type comprising a power transistor having a control terminal and a main conduction path connected between the input and the output of the voltage regulator, and an operational amplifier comprising an input differential stage biased by a bias current, and having a first input connected to a voltage reference, a second input coupled to the output of the voltage regulator, and an output connected to the control terminal of the power transistor; the method comprising the step of:

generating the bias current for the input differential stage of the operational amplifier so that the bias current varies based upon variations of the regulated output voltage at the output of the voltage regulator to increase transient response speed.

19. A method according to claim 18, wherein the step of generating the bias current comprises generating the bias current using a transconductance operational amplifier having at least one input coupled to the output of the regulator.

20. A method according to claim 19, wherein the step of generating the bias current further comprises the steps of:

generating a first current;

using the transconductance operational amplifier to generate a second current; and summing the first current and the second current to generate the bias current.

* * * * *